US005382112A

United States Patent [19]

Fu

[11] Patent Number: 5,382,112

[45] Date of Patent: Jan. 17, 1995

[54] FOLDING ROAD BARRIER

[76] Inventor: Hsiang-Wen Fu, No. 8, Alley 4, Lane 172, Min-An W. Rd., Hsin-Chuang City, Taipei Hsien, Taiwan, Prov. of China

[21] Appl. No.: 201,330

[22] Filed: Feb. 24, 1994

[51] Int. Cl.[6] ..... E01F 9/01

[52] U.S. Cl. ..... 404/6; 40/606; 40/610; 116/63 P

[58] Field of Search ..... 404/6, 9, 14; 40/606, 40/610, 612; 116/63 P, 63 R; 256/13.1, 64; 160/238, 245, DIG. 10

[56] References Cited

U.S. PATENT DOCUMENTS

| | | | |
|---|---|---|---|
| 1,794,434 | 3/1931 | Adams | 256/64 |
| 3,205,118 | 9/1965 | Guffan | 160/238 |
| 3,456,100 | 7/1969 | Green | 116/63 P |
| 4,875,302 | 10/1989 | Noffsinger | 40/606 X |
| 5,208,585 | 5/1993 | Sprague | 404/6 X |

FOREIGN PATENT DOCUMENTS

| | | | |
|---|---|---|---|
| 297324 | 6/1932 | Italy | 116/63 P |
| 312607 | 11/1933 | Italy | 116/63 P |
| 563979 | 6/1957 | Italy | 116/63 P |

*Primary Examiner*—Ramon S. Britts
*Assistant Examiner*—James A. Lisehora
*Attorney, Agent, or Firm*—Bacon & Thomas

[57] ABSTRACT

A folding road barrier includes a cross member, two folding stands pivotal connected to two opposite ends of the cross member at the bottom, a shade roller supported on and turned between two supports on the front side of the cross member for showing warning words, a signal lamp assembly mounted on the cross member at the top and controlled to give a flashing signal.

5 Claims, 5 Drawing Sheets

FOLDING ROAD BARRIER

BACKGROUND OF THE INVENTION

The present invention relates to a folding road barrier which can be conveniently collapsed for carrying by hand.

Barrier devices and signal lamp devices may be installed in the job site of a road or building construction at the entrance or any suitable location to stop people from passing or to warn people of danger. A conventional road barrier, as shown in FIG. 1, is generally comprised of two triangle stands and a cross board fastened between the triangle stands and marked with warning words. This structure of road barrier is not collapsible, therefore it is inconvenient to carry. When a road barrier is set up in the job site of a road construction or the like, a signal lamp stand, as shown in FIG. 2, may be also placed by the road barrier to give a warning signal. Because the road barrier and the signal lamp stand are separately prepared, the user must pay more installation coast. Furthermore, separately preparing the road barrier and the signal lamp will cause the user difficult to handle the delivery and storage of the equipment.

SUMMARY OF THE INVENTION

The present invention has been accomplished to provide a folding road barrier which eliminates the aforesaid problems. It is therefore an object of the present invention to provide a folding road barrier which can be conveniently collapsed for carrying by hand. It is another object of the present invention to provide a folding road barrier which has a signal lamp assembly controlled by a control box thereof to give a flashing signal.

DETAILED DESCRIPTION OF THE PREFERRED EMBODIMENT

Figure 2:
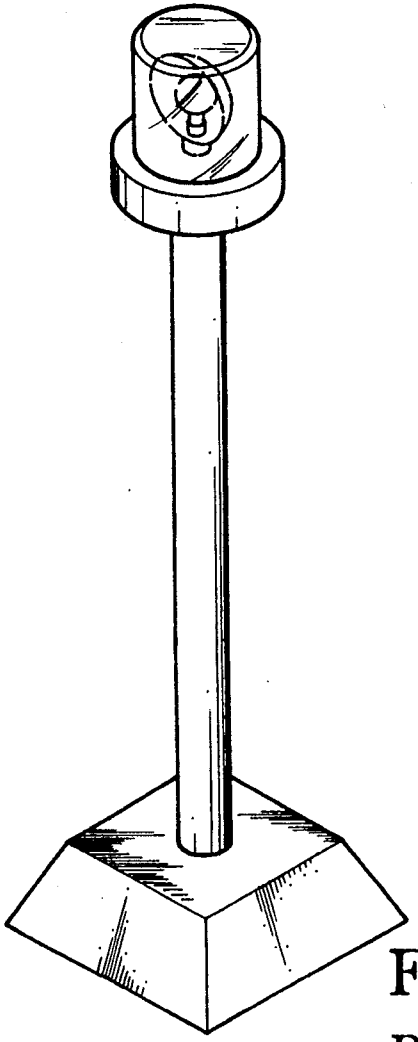
Fig.2 PRIOR ART
FIG. 2 is an elevational view of a signal stand according to the prior art.
Figure 1:
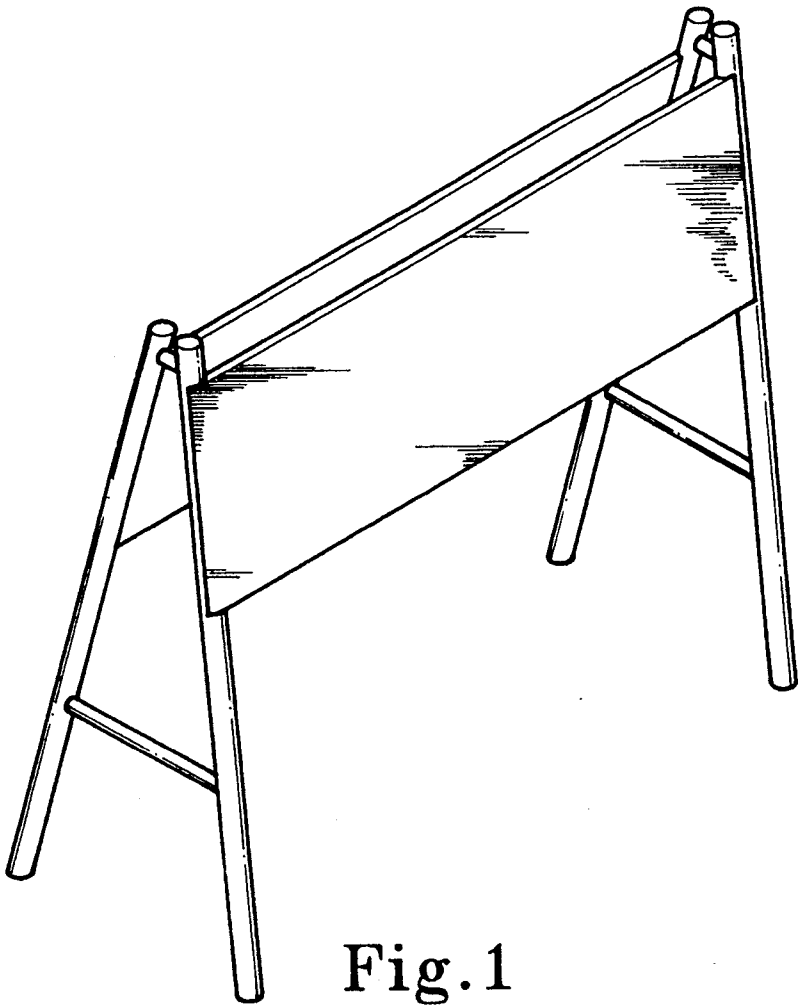
Fig.1 PRIOR ART
FIG. 1 is an elevational view of a road barrier according to the prior art.
Figure 3:
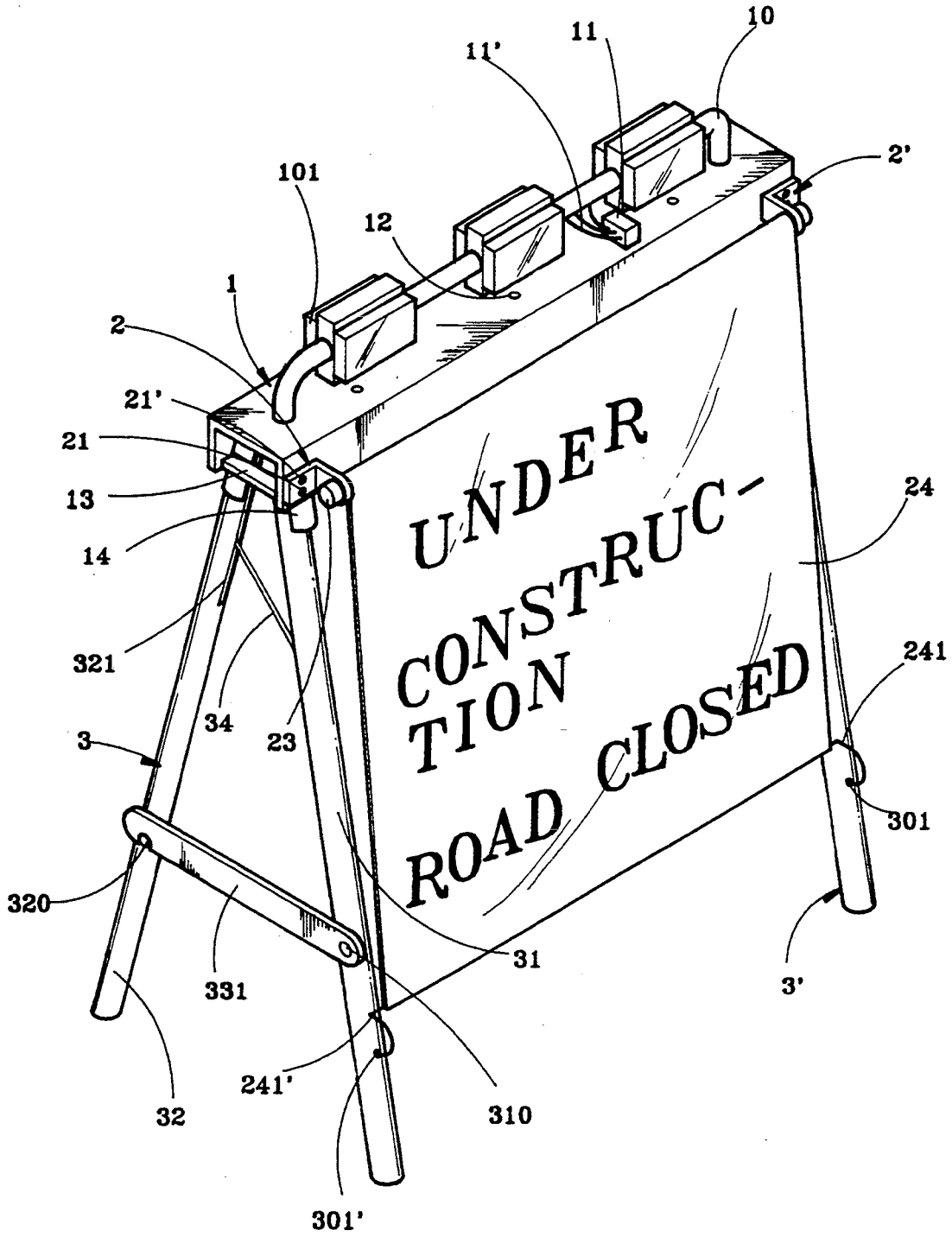
FIG. 3 is an elevational view of a folding road barrier according to the preferred embodiment of the present invention.

Referring to FIG. 3, a folding road barrier in accordance with the preferred embodiment of the present invention is generally comprised of a cross member 1, two folding stands 3;3' pivoted to two opposite ends of the cross member 1 at the bottom, a shade roller 24, and a plurality of signal lamps 101.

Figure 4:
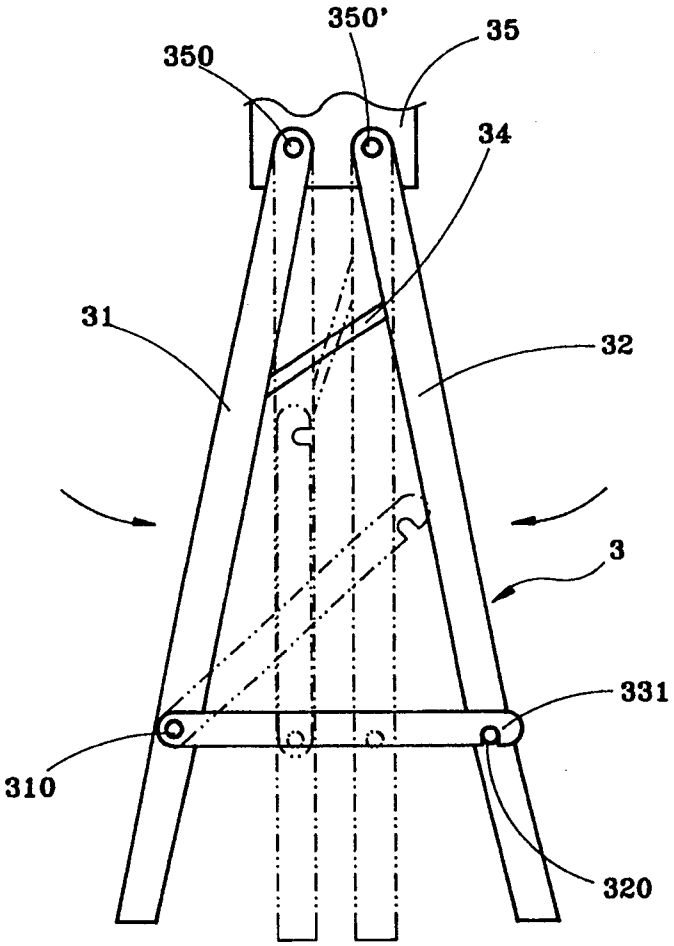
FIG. 4 shows the operation of the folding stand of the folding road barrier shown in FIG. 2.
Figure 5:
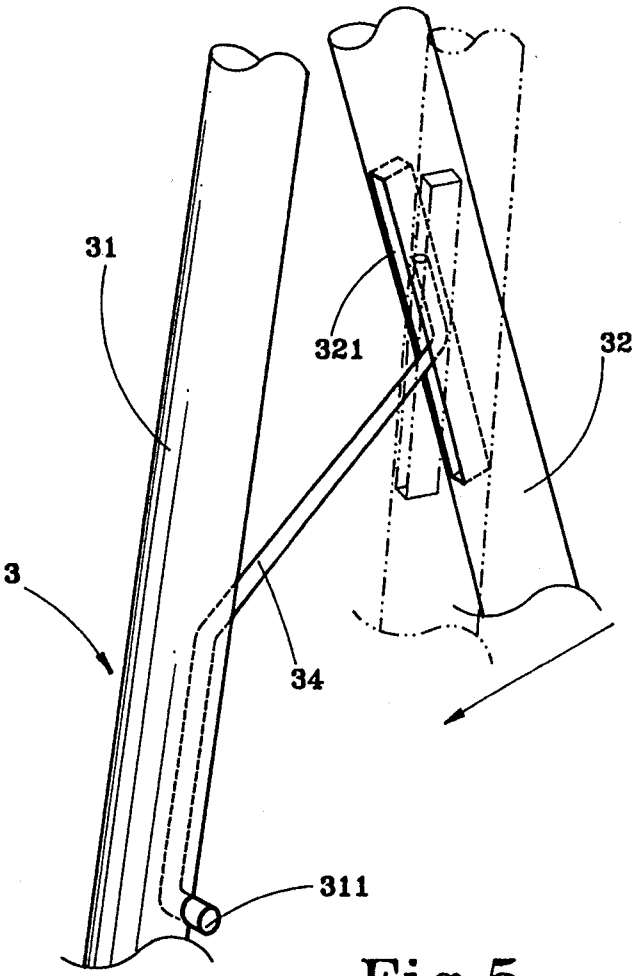
FIG. 5 shows the positioning of the movable stay between the two legs of the folding stand shown in FIG. 4.
Figure 6:
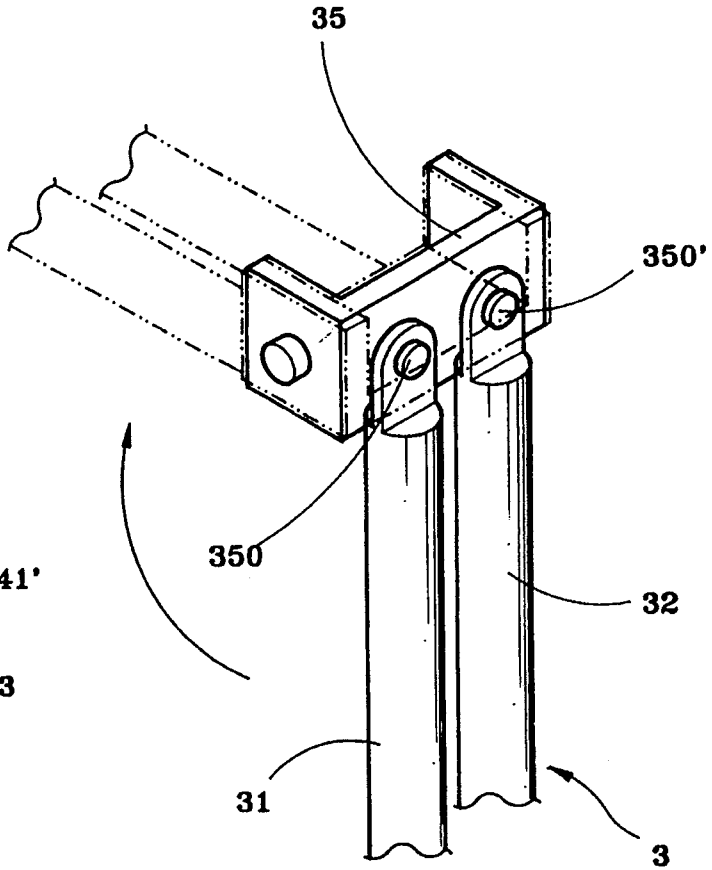
FIG. 6 shows the two legs of the stand of FIG. 4 moved between the horizontal (collapsed) position and the vertical (working) position.

Referring to FIGS. 4, 5, 6, and FIG. 3 again, the folding stand 3 or 3' comprises a pivotable mounting frame 35 pivoted to either end of the cross member 1, a first leg 31 and a second leg 32 respectively connected to an outer side of the pivotable mounting frame 35 by a respective pivot 350 or 350', a movable stay 34 having a fixed end fastened to the first leg 31 at 311 and a free end inserted into a longitudinal sliding hole 321 on the second leg 32, a hook 331 having a rear end fastened to the first leg 31 by a pivot 310 at a lower elevation relative to the movable stay 34 and a hooked front end detachably hooked on a peg 320 on the second leg 32 to hold the stand 3 or 3' in the working position. When the hook 331 is released from the peg 320, the two legs 31;32 can then be moved toward each other, and then turned from the vertical position to the horizontal position (see FIG. 6) and received to the cross member 1. There is provided a constraint plate 13 fastened between two downward plates 14 at either end of the cross member 1 to limit the swinging angle of the legs 31;32.

Figure 7:
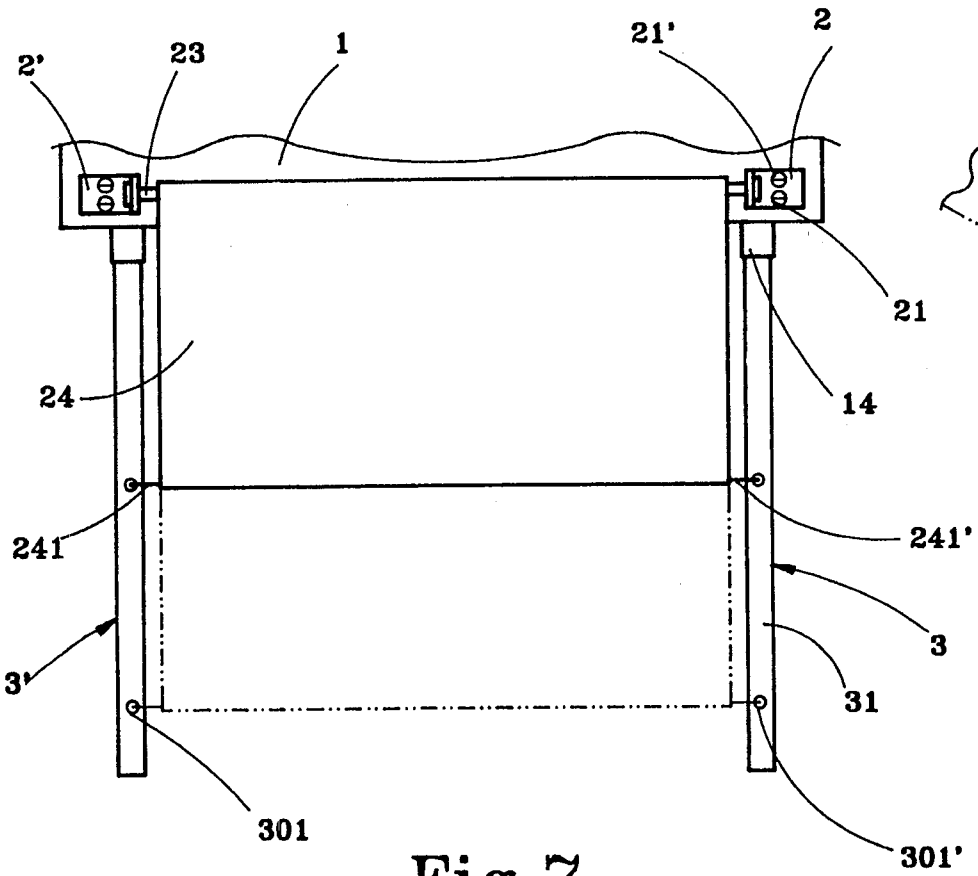
FIG. 7 is a front view in plain of the folding road barrier shown in FIG. 2, showing the shade roller extended out.

Referring to FIG. 7, two angle plates or roller supports 2;2' are respectively fastened to the two opposite ends of the cross member 1 at one side by screws 21;21' to hold the roller 23 of the shade roller 24. The front end of the shade body of the shade roller 24 has two hooks 241;241, which hook in a respective hole 301 or 301' on either stand 3 or 3' when the shade roller 24 is extended out. The shade roller 24 is provided to show warning words such as "UNDER CONSTRUCTION", "ROAD CLOSED", etc.

Referring to FIG. 3 again, the cross member 1 further comprises a top horizontal rod 10 and a series of through holes 12 at the top. A plurality of signal lamps 101 are respectively mounted on a top horizontal rod 10. A control box 11 is fastened to either screw hole 12 on the cross member 1 and connected to the signal lamps 101 by conductors 11'. A DC power supply is provided (not shown) and connected to the control box 11. By means of the control of the control box 11, the signal lamps 101 are turned to give a flashing signal.

Figure 8:
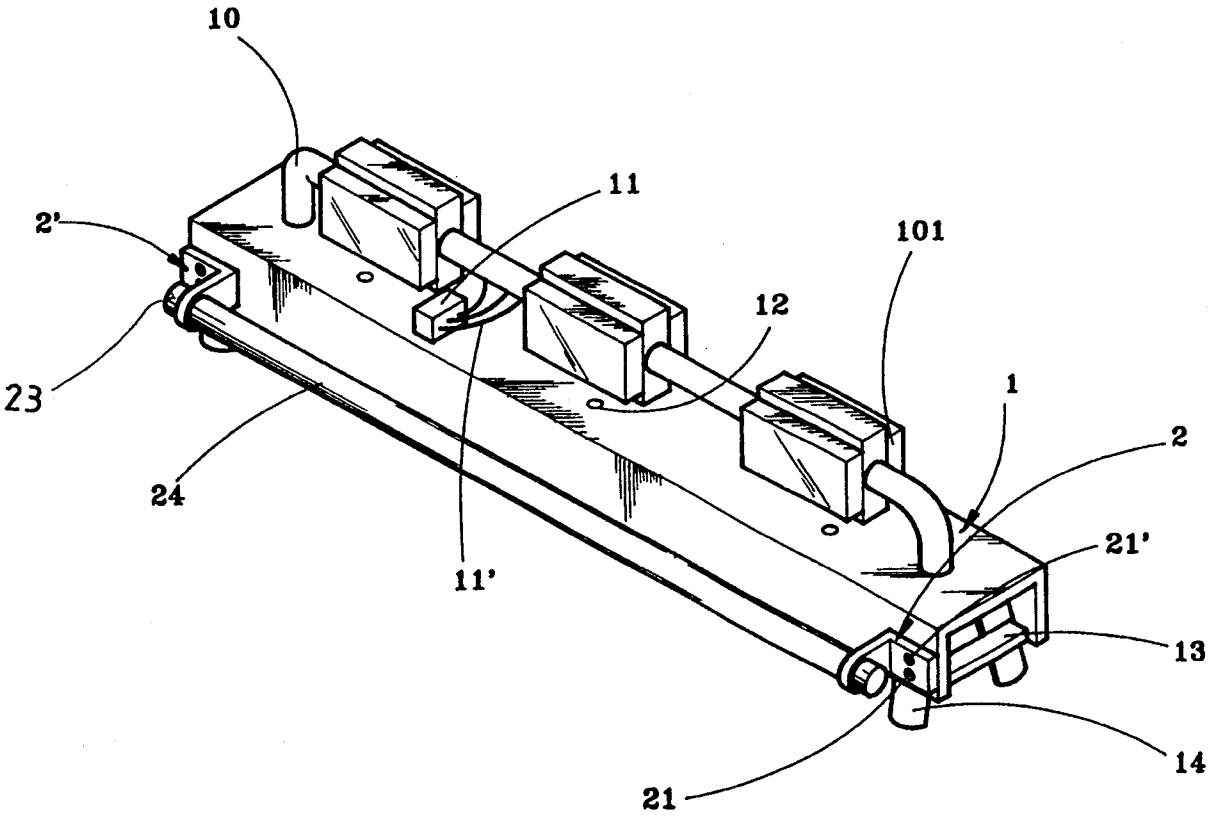
FIG. 8 shows the folding road barrier of FIG. 3 collapsed.

Referring to FIG. 8, the folding road barrier can be folded up for carrying on the shoulder conveniently. By means of the top horizontal rod 10, the folding road barrier can be conveniently carried by hand when it is collapsed.

I claim:

1. A folding road barrier comprising:

a cross member having a front side, a top, a bottom, and two opposite ends;

two roller supports projecting from said front side;

a folding stand pivotally connected to each of the two opposite ends of said cross member, each folding stand comprising a pivotably mounting frame pivoted to one of said two opposite ends of said cross member at the bottom, each mounting frame having an outer side, and each folding stand further comprising a first leg connected to the mounting frame at said outer side by a first pivot pin and a second leg connected to the mounting frame at said outer side by a second pivot pin;

a shade roller supported on and extending between said roller supports so as to be freely rotatable thereon for showing warning words;

a signal lamp assembly mounted on said horizontal top rod of said cross member; and a control circuit mounted on said cross member to control the operation of said signal lamp assembly to give a flashing signal.

2. The folding road barrier of claim 1 wherein each said first leg has a pivot thereon, wherein each said second leg has a peg projecting therefrom, wherein each folding stand has a working position, and each folding stand further comprises a hook having a rear end pivotally connected to the first leg by said pivot and a hooked front end detachably hooked on said peg on the second leg to retain each folding stand in the working position.

3. The folding road barrier of claim 1 wherein the second leg of each folding stand ha a longitudinal sliding hole and each folding stand further comprises a movable stay having a fixed end fastened to the first leg and a free end inserted into said longitudinal sliding hole.

4. The folding road barrier of claim 1 wherein said cross member further comprises two opposite pairs of downward plates at the two opposite ends thereof at the bottom, and a constraint plate fastened between said downward plates at each of said two opposite ends to limit a turning angle of the first and second legs of each folding stand.

5. The folding road barrier of claim 1 wherein said cross member further comprises a series of through holes for mounting said control circuit alternatively.

* * * * *